US005184687A

United States Patent [19]

Abdrakhmanov et al.

[11] Patent Number: 5,184,687

[45] Date of Patent: Feb. 9, 1993

[54] WELL REAMER

[76] Inventors: Gabdrashit S. Abdrakhmanov, ulitsa Gogolya, 66, kv. 71; Albert G. Zainullin, ulitsa Saidasheva, 1, kv. 117; Konstantin V. Meling, ulitsa Gafiatullina, 27, kv. 20; Rauf N. Rakhmanov, ulitsa Gafiatullina, 27, kv. 8., all of Bugulma; Alexandr P. Balandin, Krasnokamsk pereulok Pala/tinsky, 3a, kv. 90, Permskaya oblast; Alexandr A. Puzanov, ulitsa Kalinina, 67, kv. 60, Bugulma; Ilyas A. Urazgildin, ulitsa Gafiatullina, 16, kv. 70, Bugulma; Almaz A. Mukhametshin, ulitsa Gafiatullina, 26, kv. 51, Bugulma; Almas K. Khakimov, ulitsa Gafiatullina, 44, kv. 117, Bugulma; Antanas A. Yasas, ulitsa P. Tsvirkos, 15, kv. 46, Litovskaya SSR, Gargzhdai; Lutsia M. Naryshkina, ulitsa Tukhachevskogo, 6, kv. 32, Bugulma; Albert M. Akhunov, late of Bugulma; by Tanzilya K. Akhunova, administrator, ulitsa Ya. Gasheka, 7, kv. 10, Bugulma; by Flera A. Akhunova,administrator, ulitsa Ya. Gasheka, 7, kv. 10, Bugulma; by Farid A. Akhunov, administrator, ulitsa Baumana, 1, kv. 5, Bugulma, all of U.S.S.R.

[21] Appl. No.: 543,800

[22] PCT Filed: Nov. 22, 1988

[86] PCT No.: PCT/SU88/00236

§ 371 Date: Jul. 23, 1990

§ 102(e) Date: Jul. 23, 1990

[87] PCT Pub. No.: WO90/05829

PCT Pub. Date: May 31, 1990

[51] Int. Cl.[5] ..... E21B 7/28

[52] U.S. Cl. ..... 175/267; 175/271

[58] Field of Search ..... 175/265, 267, 269, 271

[56] References Cited

U.S. PATENT DOCUMENTS

| | | | |
|---|---|---|---|
| 2,630,300 | 3/1953 | Emanuel . | |
| 2,809,016 | 6/1957 | Krammerer, Jr. . | |
| 2,941,785 | 6/1960 | Kammerer | 175/267 X |
| 3,196,961 | 7/1965 | Krammerer . | |
| 4,282,941 | 8/1981 | Perkin | 175/267 |
| 4,589,504 | 5/1986 | Simpson | 175/267 |
| 4,614,242 | 9/1986 | Rives . | |
| 4,809,793 | 3/1989 | Hailey | 175/265 |
| 5,036,921 | 8/1991 | Pittard et al. | 166/298 |

FOREIGN PATENT DOCUMENTS

| | | |
|---|---|---|
| 874952 | 10/1981 | U.S.S.R. . |
| 962575 | 10/1982 | U.S.S.R. . |

*Primary Examiner*—William P. Neuder
*Attorney, Agent, or Firm*—Lilling & Lilling

[57] ABSTRACT

The well reamer comprises a sub for attaching it to the drive means, a hollow housing with a central channel and radial openings in its side wall, projectable rolling cutters with shanks, mounted in the radial openings of the housing, and a mechanism for projecting the rolling cutters, including a piston and a member for locking the rolling cutters in their operating positions. The annular piston is connected with the housing for joint rotation therewith, and is regidly connected with the sub. The wall of the piston has radial passages made therein, establishing communication between its central channel and so annular space defined between the walls of the piston and of the housing. The member for locking the rolling cutters is accommodated with a clearance in the central channels of the piston and of the housing, and has an annular shoulder. The central channel of the piston defines a seat for engagement with the annular shoulder of the locking member.

1 Claim, 1 Drawing Sheet

WELL REAMER

FIELD OF THE INVENTION

The present invention relates to well-drilling technologies, and more particularly it relates to a well reamer.

The invention can be employed to the utmost effect in the patching-off of troublesome zones encountered in a drilling operation and associated with either intense losses of the drilling mud and cement slurry, or the inflow of a liquid or gas from an exposed formation into the borehole, or else caving-in of the rock being drilled into the borehole.

BACKGROUND OF THE INVENTION

It is not unfrequent in the process of drilling a deep well for oil or gas production to encounter formations incompatible from the drilling viewpoint, e.g. formations with abnormally high or low formation pressures, or else with crumbling or caving-in rock.

To provide for further drilling without reducing the predetermined diameter of the well, a portion of the borehole in the zone of the exposed troublesome formation is reamed, and a patcher is set into this reamed portion of the borehole, e.g. in the form of a string of profile pipes which are urged against the wall of the reamed portion of the borehole by building up excessive fluid pressure inside these pipes, followed by calibrating their internal flow passage to the required well diameter.

DESCRIPTION OF THE PRIOR ART

There is known a well or borehole reamer (SU, A, 874952) comprising a housing with a connection, a piston assembly, projectable supports with rock-breaking members, and a limiter of the projection of these supports.

There is further known a well or borehole reamer (U.S. Pat. No. 2,941,785) comprising a reducer or sub for its connection with the drive, a hollow housing with a central channel and radial openings in the side wall, projectable rolling cutters, mounted in the radial openings of the housing, and a mechanism for projecting the rolling cutters from the radial openings of the housing, including an annular piston and a locking member with an annular shoulder, mounted in the housing for limited axial reciprocation.

A major drawback of the known reamers in their having no provision for self-centering of the rock-breaking members (e.g. the rolling cutters) with respect to the borehole wall, whereby more often than not the surface of the reamed portion of the borehole becomes irregular or eccentric with respect to the well axis. This drawback threatens poor quality of the subsequent patching-off of the formation and complicates further drilling on account of the irregular diameter of the patching in the patching means, opposing normal running-in and pulling-out of the drilling tools.

Another shortcoming of the known reamers is their not being adapted for monitoring the operation of the reamer in the well by the drilling personnel, as the known reamers send out no signal of the rolling cutters having been projected into their working positions. This shortcoming also threatens poor quality of the reaming of the borehole or well.

It is an object of the present invention to enhance the performance reliability of a well reamer.

It is another object of the present invention to enhance the quality of the work of reaming the wall of a borehole or well.

SUMMARY OF THE INVENTION

It is the main object of the present invention to create a well reamer of a structure providing for full projection of the rolling cutters from the housing into their operating position, with simultaneous self-centering of the rolling cutters with respect to the wall of the borehole or well.

This object is attained in a well reamer comprising a sub for attaching it to the drive means, a hollow housing with a central channel and radial openings made through its side wall, projectable rolling cutters, mounted in the radial openings of the housing, and a mechanism for projecting the rolling cutters from the radial openings of the housing, including an annular piston and a member for locking the rolling cutters. In accordance with the present invention, the piston is connected with the housing for joint rotation therewith and is rigidly connected with the sub, the wall of the piston having radial passages made therethrough, establishing communication of its central channel with an annular space defined between the wall of the piston and the internal wall of the housing. The member for locking the rolling cutters is accommodated with a clearance in the central channels of the piston and of the housing and having an annular shoulder. The central channel of the piston defines a seat for engagement with this annular shoulder of the locking member. The annular shoulder of the locking member and the internal surface of the housing have matching longitudinal passages made therein in the area of interaction of the locking member with the rolling cutters, for communicating the central channel of the piston with the internal space of the lower part of the housing.

The disclosed reamer with its piston positively connected with the drive means improves the conditions of retracting the locking member from its operating position and moving the rolling cutters into their transport state. In the well reamer according to the invention, with the locking member of the rolling cutters being mounted with a clearance in the central channel of the piston, self-centering of the rolling cutters with respect to the borehole wall is provided for, with radial runout of the reamer in operation avoided and the rolling cutters being thus safeguarded against non-uniform wear. With non-uniform displacement of the rolling cutters from the well axis precluded, single-sided rock-cutting is prevented, so that the quality of the reaming jobs in enhanced. This positive effect is augmented by the fact that a reduction of the pressure drop across the central channel of the reamer and the bottom hole becomes representative of the completeness of projection of the rolling cutters into their operating positions, so that work with incompletely projected cutters can be avoided, which otherwise threatens defective borehole enlargement.

BRIEF DESCRIPTION

Other objects and advantages of the present invention will be made apparent in the following description of its preferred embodiment, with reference being to the accompanying drawings, wherein.

PREFERRED EMBODIMENT OF THE INVENTION

Figure 1:
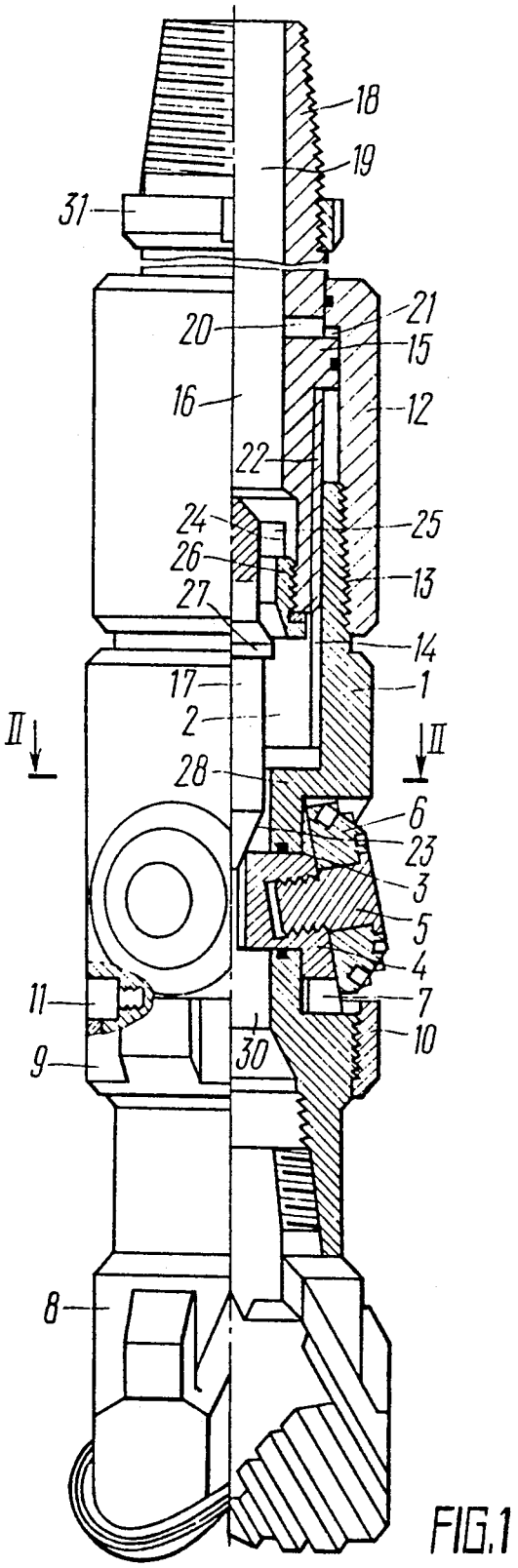
FIG. 1 is a partly longitudinally sectional general view of a well reamer embodying the invention in its round-trip or transport state.

The well reamer embodying the invention comprises a hollow cylindrical housing 1 (FIG. 1) with a central channel 2 and radial openings 3 made through its side wall, movably receiving therein shanks 4 with the arbors 5 of radially projectable rolling cutters 6 in the form of truncated spherical segments. A key 7 secures each respective shank 4 from rotation in its radial opening 3. The lowermost end of the housing 1 carries a drilling bit 8 and a coupling nut 9 with lugs 10 vertically aligned with the rolling cutters 6, serving to center the reamer in a borehole and to protect the rolling cutters 6 from damage during running pulling operations. A lock screw 11 secures the coupling nut 9 from accidental unscrewing.

The upper part of the housing 1 is in the form of a coupling nut 12 on a thread 13 connecting it to the rest of the housing 1, with longitudinal spline grooves 14 cut in the internal wall of the main part of the housing 1.

The central channel 2 of the housing 1 accommodates a mechanism (not generally designated in the drawings) for projecting the rolling cutters 6, including an annular piston 15 with a central channel 16, accommodated inside the coupling nut 12, and a member 17 for locking the shanks 4 of the respective rolling cutters 6 in their operating positions.

To connect the reamer with the drive means (not shown), the former is provided in its upper part with a reducer or sub 18 with a central channel 19, rigidly connected with the annular piston 15. The central channel 19 of the sub 18 communicates with the central channel 16 of the annular piston 15, and also communicates via radial passages 20 with an above-piston annular space 21. The lower part of the piston 15 is provided with splines 22 engaged in the spline grooves 14 of the housing 1. The lower part 23 of the locking member 17 is tapered, with the locking member 17 being received in the central channel 16 of the piston 15 with a clearance and having at its top an annular shoulder 24 with longitudinal passages 25, adapted to engages a seat 26 provided in the central channel 16 of the piston 15. Furthermore, the locking member 17 has another annular shoulder 27 for engagement with an annular seat 28 of the housing 1. The internal surface of the housing 1 has longitudinal passages 29 (FIG. 2) made therein in the area of interaction of the rolling cutters 6 (FIG. 1) with the locking member 17, for establishing communication of the central channel 16 of the piston 15 with a space 30 in the lower part of the housing 1.

The sub 18 is provided with a thrust nut 31 for its reliable connection to the drive means (not shown).

The herein disclosed well reamer is operated, as follows.

Figure 3:
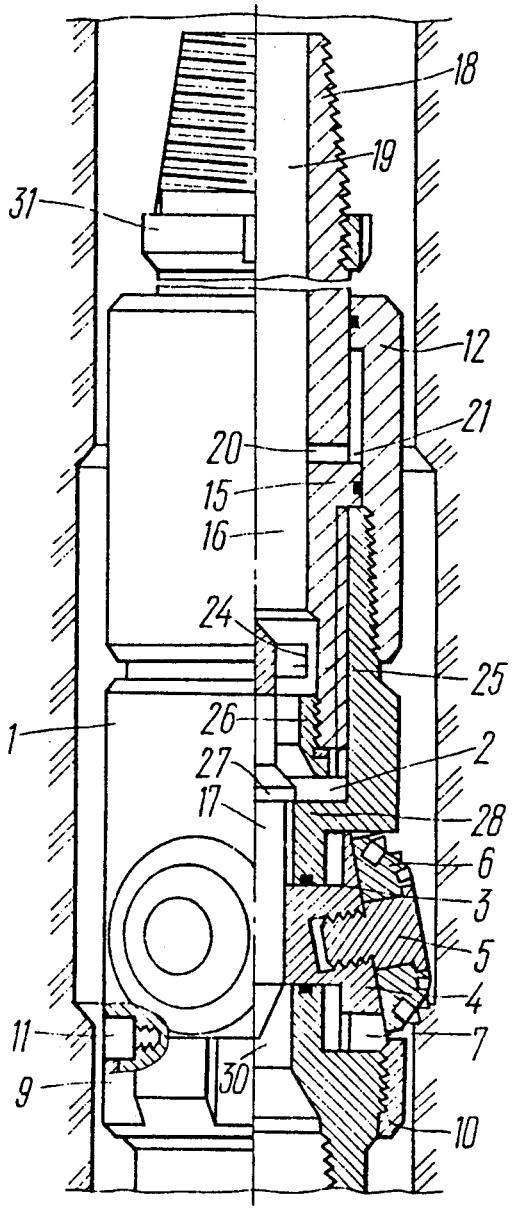
FIG. 3 is a partly general, partly longitudinally sectional view of the reamer of FIG. 1 in its operating state.

The reamer is joined through the sub 18 to the drive means (not shown, e.g. a downhole motor which may be an electric downhole motor or a turbodrill) mounted on the bottom end of the drill pipe string (not shown, either), and run into the required interval of the borehole or well, which is to be enlarged by reaming (FIG. 3). Then the drill pipe string (not shown) is rotated, supplying at the same time into it the drilling mud under pressure, which flows via the central channel 19 of the sub 18, the central channel 16 of the piston 15, the longitudinal passages 25 in the annular shoulder 24 of the locking member 17 and the channels 2, 29 of the housing 1 to the flushing openings (not shown) of the drilling bit 8 (FIG. 1).

Figure 2:
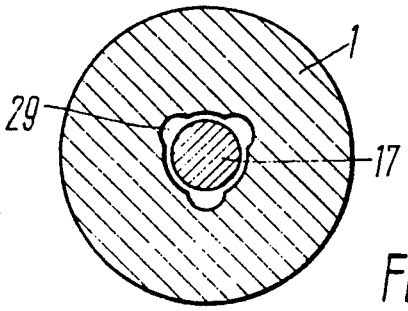
FIG. 2 is a sectional view taken on line II—II of FIG. 1.

Initially, as shown in FIG. 1, the rolling cutters 6 do not project beyond the confines of the housing 1, and the annular shoulder 24 of the locking member 17 engages the seat 26 of the piston 15. However, the pressure drop applied to the top face of the piston 15 via the radial passages 20 makes the coupling nut 12 with the rest of the housing 1 move upwardly with respect to the piston 15, as shown in FIG. 3, the driving torque being transmitted via the sub 18 fast with the piston 15 to the housing 1 with the aid of the splines 22 of the piston 15 engaged in the spline grooves 14 of the housing 1. With the housing 1 moving upwardly relative to the piston 15, the shanks 4 in their engagement with the tapering downmost end 23 of the locking member 17 are forced radially outwardly through the radial openings 3, projecting the respective rolling cutters 6 for reaming the borehole wall. With the rolling cutters 6 thus completely projected, which is the moment when the cylindrical part of the locking member 17 engages the shanks 4, this cylindrical part reliably locks the shanks 4 with the rolling cutters 6 projected from the housing 1. By this moment the seat 28 of the housing 1 engages the other annular shoulder 27 of the locking member 17, lifting the latter so that its annular shoulder 24 is lifted off the seat 26 of the piston 15. With the gap thus formed between the bottom face of the annular shoulder 24 of the locking member 17 and the seat 26 of the piston 15, the pressure drop across the piston 15 sharply declines, which is registered by the appropriate pressure gauges (not shown). This declining pressure attests to the rolling cutters 6 having been completely projected into engagement with the borehole wall, reaming it to the predetermined diameter. Now, by running the disclosed reamer down, the borehole or well is enlarged to the required diameter over the preset interval. The downward axial thrust makes the rock-breaking elements (not indicated in the drawings) of the rolling cutters 6 penetrate the rock and cut it, while the calibrating elements (not indicated, either) of the cutters 6 smooth down all the irregularities of the borehole or well wall. With the reaming operation completed, the pumping of the drilling mud is discontinued, and the reamer is pulled out to the surface, with the housing 1 moving down relative to the piston 15 under its own weight and the locking member 17 being correspondingly withdrawn from the shanks 4, so that the reaction of the unenlarged part of the borehole forces the rolling cutters 6 with their shanks 4 back into the housing 1, in which way the disclosed reamer is restored to its transport state.

INDUSTRIAL APPLICABILITY

The invention can be most effectively used in the patching-off of troublesome zones encountered in a drilling process.

We claim:

1. A well reamer comprising a sub for attaching it to the drive means, a hollow housing with a central channel and radial openings made through its side wall, projectable rolling cutters with shanks, mounted in the radial openings of the housing, and a mechanism for projecting the rolling cutters from the radial openings of the housing, including an annular piston and a member for locking the rolling cutters, characterized in that the piston is connected with the housing for joint rotation therewith and is rigidly connected with the sub, the wall of the piston having radial passages made therethrough, establishing communication of its central channel with an annular space defined between the wall of the housing, the member for locking the rolling cutters being accommodated with a clearance in the central channels of the piston and of the housing, respectively, and having an annular shoulder, the central channel of the piston defining a seat for engagement with this annular shoulder of the locking member, the annular shoulder of the locking member and the internal surface of the housing having matching longitudinal passages made therein in the area of interaction of the locking member with the rolling cutters, for communicating the central channel of the piston with the internal space of the lower part of the housing.

* * * * *